US006428683B1

(12) United States Patent
Jaworowski et al.

(10) Patent No.: US 6,428,683 B1
(45) Date of Patent: Aug. 6, 2002

(54) FEEDBACK CONTROLLED AIRFOIL STRIPPING SYSTEM WITH INTEGRATED WATER MANAGEMENT AND ACID RECYCLING SYSTEM

(75) Inventors: Mark R. Jaworowski, Gastonbury; Christopher C. Shovlin, Wethersfield; Glenn T. Janowsky, Coventry; Curtis H. Riewe, Manchester; Michael A. Kryzman, W. Hartford, all of CT (US)

(73) Assignee: United Technologies Corporation, Hartford, CT (US)

( * ) Notice: Subject to any disclaimer, the term of this patent is extended or adjusted under 35 U.S.C. 154(b) by 39 days.

(21) Appl. No.: 09/738,449

(22) Filed: Dec. 15, 2000

(51) Int. Cl.[7] ..... C25F 7/02

(52) U.S. Cl. ..... 205/673; 205/717; 205/723; 205/771; 204/227; 204/237; 204/239; 204/275.1

(58) Field of Search ..... 205/673, 717, 205/723, 771; 204/227, 237, 239, 275.1

(56) References Cited

U.S. PATENT DOCUMENTS 5,882,500 A * 3/1999 Abedian et al. ..... 205/497

* cited by examiner

*Primary Examiner*—Arun S. Phasge
(74) *Attorney, Agent, or Firm*—Bachman & LaPointe, P.C.

(57) ABSTRACT

The present invention relates to a feedback controlled stripping system with integrated water management and acid recycling system. The system comprises a stripping tank containing an electrolyte bath stripping solution for removing a coating from at least one workpiece immersed in the stripping solution while a controlled absolute electrical potential is maintained on the at least one workpiece with respect to a reference electrode also immersed in the stripping solution, a rinse tank for rinsing the workpiece(s) after removal of the workpiece(s) from the stripping tank, and a distillation unit for receiving electrolyte containing dissolved metals from the stripping tank, for purifying the electrolyte received from the stripping tank, and for returning the purified electrolyte to the stripping tank. In a preferred embodiment, the stripping tank, the rinse tank, and the distillation unit are mounted to a skid. The system further includes a control module. A process for using the system to remove a coating from a workpiece is also described.

30 Claims, 4 Drawing Sheets

FEEDBACK CONTROLLED AIRFOIL STRIPPING SYSTEM WITH INTEGRATED WATER MANAGEMENT AND ACID RECYCLING SYSTEM

BACKGROUND OF THE INVENTION

The present invention relates to a system for stripping coatings from workpieces which has an integrated water management and acid recycling system and a process for using same.

Gas turbine engines in aircraft are taken out of service at periodic intervals and regular maintenance service is performed on them. Part of the regular repair sequence for the blades and vanes (individual or together referred to hereafter as "airfoils") of these engines includes the removal and then replacement of the worn coatings from their surfaces. These coatings are usually either an aluminide coating or an MCrAlY coating. The underlying base metal of airfoils are generally made of either a nickel base alloy or a cobalt base alloy. These coatings provide airfoils with a barrier to the hot corrosive environment in which airfoils operate.

In the past, these aluminide and MCrAlY coatings were removed from airfoils by soaking the parts either in nitric acid solutions (to remove aluminide-type coatings) or in hydrochloric acid solutions (to remove MCrAlY-type coatings) in high acid concentrations for up to six hours at elevated temperatures. This soaking process has several disadvantages associated with it.

This soaking process is extremely labor intensive and can produce non-uniform and unpredictable results. It can also damage or destroy airfoils if improperly carried out. Furthermore, each airfoil part requires extensive masking to protect areas sensitive to the acid soaking solution. Such areas include internal surfaces and the root section of the airfoil. These masking operations are costly, add significant time to the repair process and, if not properly carried out, can lead to damaged or destroyed parts. Still further, these soaking processes may result in extensive amounts of acidic waste solution that must be properly disposed of as well as have a long cycle time and require relative large amounts of energy to heat the acidic solutions.

A better airfoil stripping process is needed by the engine maintenance and repair industry. This better airfoil stripping process should be one that has a reduced cycle time; requires reduced amount of labor; requires less masking and lower operating temperatures; produces less hazardous waste effluent; requires less heating energy; produces uniform and predictable stripping results so that fewer parts are damaged, destroyed or require recycling. Such a stripping process has been presented in allowed co-pending U.S. patent application Ser. No. 09/216,469, filed Dec. 18, 1998, entitled FEEDBACK CONTROLLED STRIPPING OF AIRFOILS. In this process, a coating is electrochemically stripped from an airfoil by immersing the airfoil in an electrochemical acid bath for a sufficient period of time to remove the coating from the airfoil while maintaining a controlled absolute electrical potential with respect to a reference electrode on the airfoil surface.

In order to make the stripping process commercial, the expended stripping solution and the waste water that is created from rinsing the stripping solution must be managed. In the past this has required the use of large industrial waste water treatment plants.

SUMMARY OF THE INVENTION

Accordingly, it is an object of the present invention to provide a feedback controlled stripping system with an integrated water management and electrolyte recycling system which can be used to strip or remove coatings from a wide variety of workpieces.

It is a further object of the present invention to provide a process for utilizing the system to strip coatings from a wide variety of workpieces.

The foregoing objects are attained by the system and the process of the present invention.

In accordance with the present invention, a feedback controlled stripping system is provided with integrated electrolyte recycling. This allows protective coatings to be removed from turbine blades, vanes, and other workpieces, as well as permitting brazing and solder compounds to be removed from metals, in cold, dilute acid without masking by the use of controlled potential stripping. The integration of a recycling system based on acid distillation stabilizes the chemistry of the stripping solution while minimizing the volume of chemical waste created by the process. The integration of zero waste water discharge equipment allows the system to be located in facilities lacking central waste water treatment plants.

The coating removal system of the present invention broadly comprises a stripping tank containing an electrolyte bath stripping solution for removing a coating from at least one workpiece immersed in the electrolyte bath while a controlled absolute electrical potential is maintained on the at least one workpiece with respect to a reference electrode immersed in the electrolyte bath; a rinse tank containing a rinse solution for rinsing the at least one workpiece after completion of removal of the coating from the at least one workpiece; and a distillation unit for receiving used electrolyte from the stripping tank containing dissolved metals, for purifying the electrolyte received from the stripping tank and for returning the electrolyte in a purified form to the stripping tank. In a commercial embodiment, the stripping tank, rinse tank, and distillation unit are mounted on a skid. The coating removal system further comprises a control module for operating the system.

A process for removing a coating from a workpiece using an acid bath stripping solution and for regenerating the stripping solution broadly comprises the steps of stripping a coating from a workpiece by immersing the workpiece in an electrochemical acid bath for a period of time sufficient to remove the coating from the workpiece while the workpiece in the electrochemical bath is maintained with a controlled absolute electrical potential with respect to a reference electrode and regenerating the electrochemical acid bath by atmospheric distillation of the electrochemical acid bath.

Other details of the system and the process of the present invention, as well as other objects and advantages attendant thereto, are set forth in the following detailed description and the accompanying drawings in which like reference numerals depict like elements.

DESCRIPTION OF THE PREFERRED EMBODIMENTS

Figure 1:
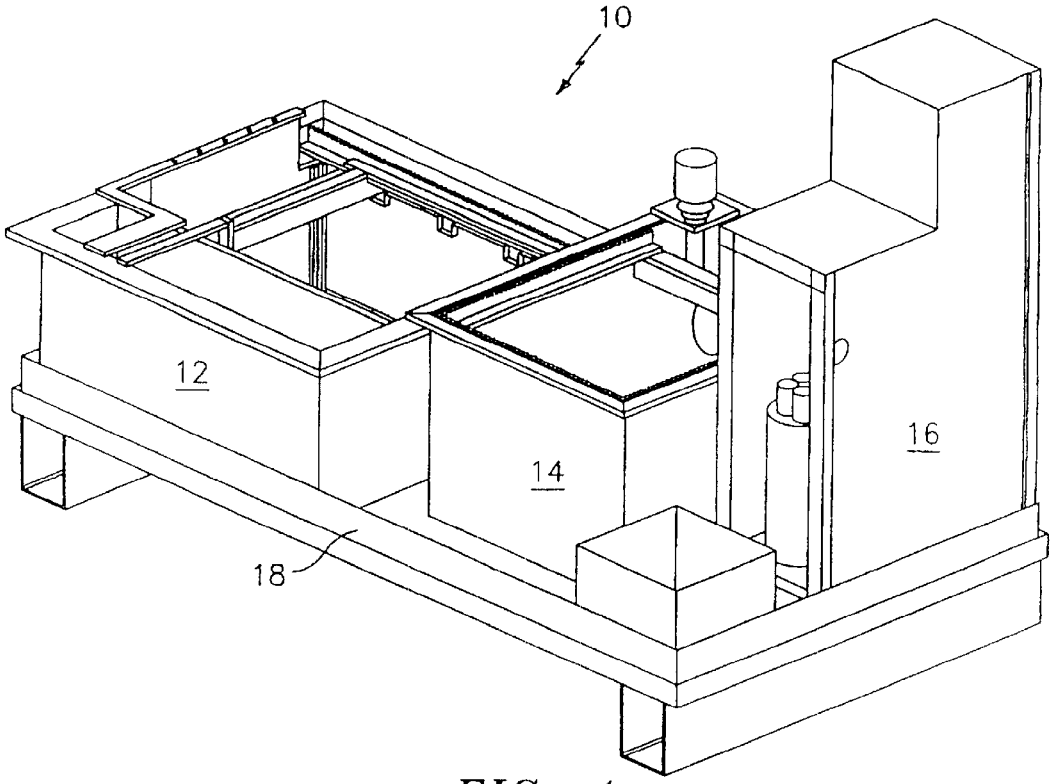
FIG. 1 is a schematic representation of a feedback controlled stripping system with integrated water management and electrolyte recycling system in accordance with the present invention.

The phrase "controlled absolute electrical potential with respect to a reference electrode" as used herein means the electrical potential as measured between the airfoil (as a working electrode) and a non-polarized reference electrode in a three-wire electrode setup in the electrochemical acid bath is controlled to affect a suitable rate of stripping of the coating from airfoil base metal.

A phrase "controlled electrical current density on the airfoil surface" as used herein means the electrical current is measured as the current flow between the airfoil and the counter electrode in the electrochemical acid bath while the absolute potential of the airfoil is monitored with respect to a non-polarized reference electrode also present in the electrochemical acid bath.

The phrase "three wire electrode setup" as used herein refers to the use of an airfoil as the working electrode while also have at least one counter electrode and non-polarized reference electrode in the electrochemical acid bath.

The word "coating" as used herein refers to a coating applied to an airfoil such as a barrier coating, a solder or braze joining compound applied to a metal part, an electroplated coating applied to a steel component, and the like.

The technique used in the present invention to strip coatings from workpieces such as turbine blades and vanes and other metal objects and/or to remove braze or solder compounds from metallic workpieces is based on the application of an external anodic current to the workpieces, which results in an increase in the potential of the workpieces. Thus, the rate of the acidic stripping process is increased significantly while being able to operate at either lower acid concentrations, at lower operating temperatures and/or at shorter periods of time than conventional soaking processes. This use of less aggressive solutions or lower temperatures or shorter reaction times or combinations thereof allows for use of less costly and less complex masking materials. Furthermore, upon removal of the coating material, the electrochemical current may be automatically stopped or reversed to obtain the desired stripping effect without going too far and thus destroying or damaging the workpiece.

The present invention can be carried out using controlled absolute potential stripping. The coatings that may be removed by this process include one or more aluminide-type coatings or one or more MCrAlY-type coatings or mixtures thereof. Examples of MCrAlY-type coatings include NiCoCrAlY, NiCrAlY and CoCrAlY. The technique of the present invention may also be used to remove braze and/or solder joining compounds from metallic components.

The controlled potential stripping preferably uses a constant absolute electrical potential on the workpiece in the acid bath. The constant potential provides activation energy for dissolution of the coating/brazing/solder material, and also causes a difference in the intrinsic corrosion current density between the workpiece base material and the coating/brazing/soldering material. Alternatively, it may be desired in some situations to employ a variable absolute potential with respect to a reference electrode. By controlling the absolute potential of the workpiece, the coating removal rate will vary over time (i.e. will be smaller as more is removed). This embodiment provides good selectivity for coating/braze/solder removal, but requires a complex potentiostatic power supply. Accordingly, controlled absolute potential stripping is preferred where selectivity is the primary concern.

It is desirable to select the optimum electrical potential for conducting this electrochemical reaction. This optimum level may be found by measuring the current density of coated and stripped workpieces to find the optimum point where the selectivity of stripping the coated/brazed/solder material from the workpiece metal is greatest.

Preferably, the electrochemical tank may be of any standard acid resistant material. An external anionic current may be applied to the workpieces which may be fully or partly immersed in the acidic electrolyte bath in the tank. The working electrodes for the baths will be the workpieces themselves. One or more counter electrodes (preferably, standard graphite electrodes) will be placed in the bath. A reference electrode (an Ag/AgCl or a hydrogen reference electrode) is also placed in the bath. Specially, the workpiece may be first suitably masked (which may be less than the masking required for the conventional soaking process) to cover any acid sensitive surfaces. The workpieces are preferably affixed to an insulating fixture at the root section or base portion of the workpiece. The root or base sections may not be immersed in the bath and unlike the conventional soaking stripping process, thus do not require masking. The insulating fixture holding one or more of the workpieces is preferably made of titanium or any other suitable noble metal. Alternatively, the workpiece may be completely immersed after masking the root or base section and other acid sensitive surfaces.

In operation one or more of the root or base sections of the coated/brazed soldered workpieces are preferably clamped into the titanium fixture or other type of insulating fixture. The workpieces are then partly or fully immersed in the acidic solution. The electrical current is applied with the absolute electrical potential of the workpiece being controlled. The reference electrode is used to measure or monitor the electrical potential of the workpiece in the bath. In the case of controlled electrical potential stripping, the reference electrode is connected to potentiostat/galvanostat whereby the degree of stripping may be monitored.

The electrochemical stripping bath may contain any suitable acidic solution. Preferably, the acid is either a nitric acid or hydrochloric acid. Any suitable acid concentration up to concentrated solutions may be used. Aqueous acid concentrations containing about 3% to about 15% by volume technical grade acid in water (most preferably nitric or HCl) are preferred because of the greater selectivity achieved with them over more concentrated acid solutions.

The electrochemical operations used to carry out the present process may be carried out for any suitable amount of time and at any temperature to remove the coating/solder/braze from the workpiece without harming the underlying base metal of the workpiece. Preferably, these stripping operations may be carried out at room temperature and for about 15 to about 300 minutes. These conditions are lower and shorter than the conventional soaking processes.

The end point of the stripping process may be predetermined by any standard end-point technique. These include a linear extrapolation of the current/time curve to the time corresponding at zero current; a predetermined ratio of the initial current to the measured current; by predetermined alternating current (AC) or voltage measurements; or by a predetermined absolute quantitative end-point value of current where the process will stop or be reversed.

The present invention is further described in detail by means of the following Examples.

EXAMPLES 1–2

EXAMPLE 1

CONTROLLED POTENTIAL STRIPPING OF ALUMINIDE COATING

Six airfoils (PW4000 $2^{nd}$ stage blades fabricated with a single crystal nickel-based superalloy base metal) bearing an aluminide coating, (approximately 0.001" thick) were clamped by their root section into a titanium fixture. These coated airfoils were engine-run for 5,000–11,000 hours. These six airfoils were immersed in the tip-down orientation in a tank containing a solution of 5% by volume concentration hydrochloric acid in water at room temperature. The blades were submerged to their platform level so that the acid solution contacted the areas requiring coating removal but not the root section.

The acid tank also contained an insert comprised of three graphite plates that functioned as counter electrodes. The tank also contains a silver/silver chloride reference electrode, (e.g. Model A6-4-PT available from GMC Corrosion of Ontario, Calif.).

The blades under open circuit conditions were initially at a potential of −350 mV vs. Ag/AgCl. The potential of the blades with respect to the Ag/AgCl reference electrode was adjusted using an external power supply to a controlled value of +200 mV (that has been determined experimentally to provide the greatest selectivity between −350 mV and +500 mV for coating removal). The current flow between the blades and the counter electrode assembly was monitored (by the extrapolated zero-point algorithm based on numeric differentiation of the current/time waveform) to determine the point in time when the aluminide coating would be completely removed. The coating was completely stripped after 45 minutes, and the current flow was discontinued, and the airfoils were removed from the stripping bath.

The completeness of the coating removal was verified non-destructively through heat-tinting one of the six airfoils at 1050° F. in air to produce a characteristic blue color. Additionally, another airfoil was sectioned and examined metallographically to verify the completeness of coating removal and the absence of base metal attack.

EXAMPLE 2

CONTROLLED POTENTIAL STRIPPING OF MCrAlY COATING

Six airfoils (PW4000 $1^{st}$ stage blades fabricated with a single crystal nickel-based superalloy base metal) bearing a NiCoCrAlY coating,(approximately 0.004" thick) were clamped by their root section into a titanium fixture. These coated airfoils were engine-run for about 5,000 to 11,000 hours. The six airfoils were immersed in the tip-down orientation in a tank containing a solution of 5% by volume concentration hydrochloric acid in water at room temperature. The blades were submerged to their platform level so that the acid solution contacted the areas requiring coating removal, but not the root section.

The tank of solution contained an insert comprised of three graphite plates that functioned as counter electrodes. The tank also contained a silver/silver chloride reference electrode used in Example 1.

The blades under open circuit conditions were initially at a potential of −350 mV vs. Ag/AgCl). The potential of the blades with respect to the Ag/AgCl referenced electrode was adjusted using an external power supply to a controlled value +105 mV (that has been determined experimentally to provide the greatest selectivity between −350 mV and +500 mV for coating removal). The current flow between the blades and the counter electrode assembly was monitored (by the extrapolated zero-point algorithm based on numeric differentiation of the current/time waveform) to determine the point in time when the aluminide coating would be completely removed. When the coating was completely stripped, the current flow was discontinued, and the airfoils were removed from the stripping bath.

The completeness of the coating removal was verified non-destructively through heat-tinting one of the airfoil parts at 1050° F. in air to produce a characteristic blue color. Additionally, another airfoil was sectioned and examined metallographically to verify the completeness of coating removal and the absence of base metal attack.

Having described the stripping process, attention is now turned to implementing use of the process in a commercial environment. Referring now to FIG. 1, a commercial system 10 in accordance with the present invention is shown. The commercial system comprises a stripping tank 12 containing an acid electrolyte bath stripping solution, a zero discharge rinse tank 14 containing a rinse solution such as water, and a distillation unit 16 for recycling and regenerating the stripping solution integrated on a containment skid 18.

Figure 3:
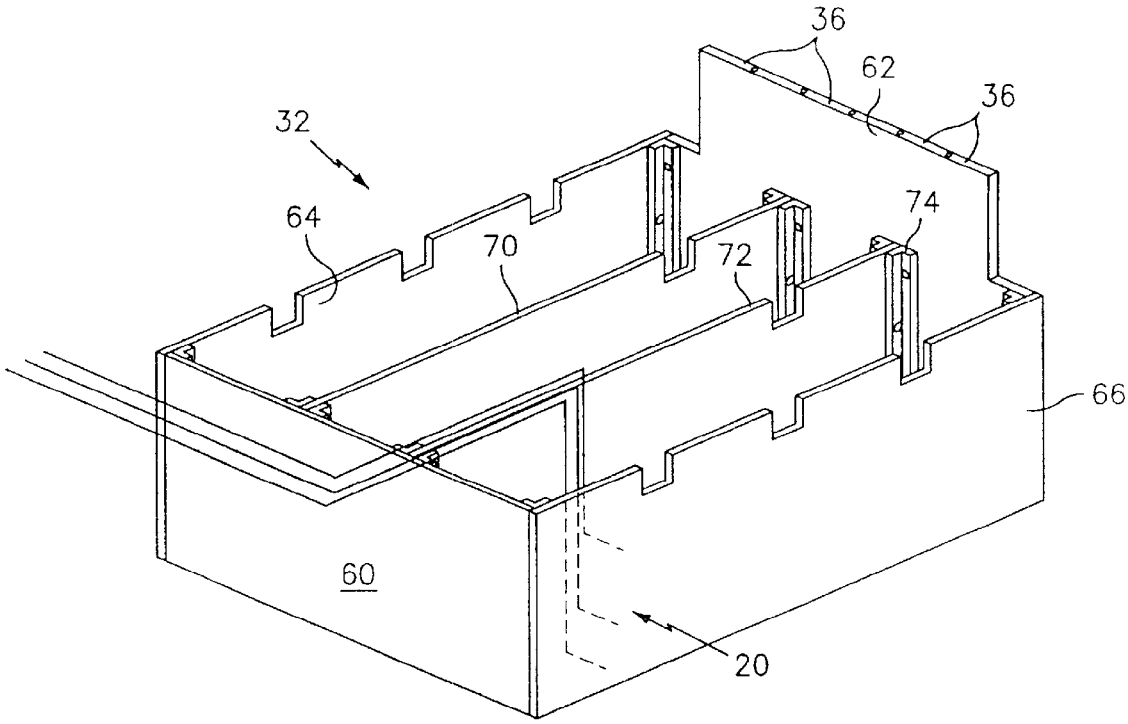
FIG. 3 illustrates a counter electrode array used in the stripping tank in the system of FIG. 1.

The stripping tank 12 contains the acid bath stripping solution (not shown), a reference electrode 20, and an electrodeless conductivity probe 24, such as a conductivity meter, for monitoring the quality of the stripping solution. In a preferred embodiment, the reference electrode 20 is actually a hydrogen reference electrode array. The stripping tank contains a counter electrode array 32, such as that shown in FIG. 3, for providing a symmetrical solution potential distribution to each workpiece 33 immersed wholly or partly in the stripping solution. The counter electrode array 32 has four walls 60, 62, 64, and 66 formed from graphite or any other suitable electrically conductive material and a pair of inserts 70 and 72 also formed from graphite or any other suitable electrically conductive material secured to the walls 60 and 62 by corner pieces 74 or any other suitable means known in the art. The counter electrode array 32 is designed to symmetrically enclose the workpiece(s) 33 from which the coating is being stripped. While the counter electrode array 32 has been shown as having a pair of inserts, the array could have just one insert or it could have more than two inserts.

The rear wall 62 of the array 32 has buss strips 36 running along its top. The buss strips 36 are preferably formed from grade 2 titanium plate or some other suitable electrically conductive material.

Figure 4:
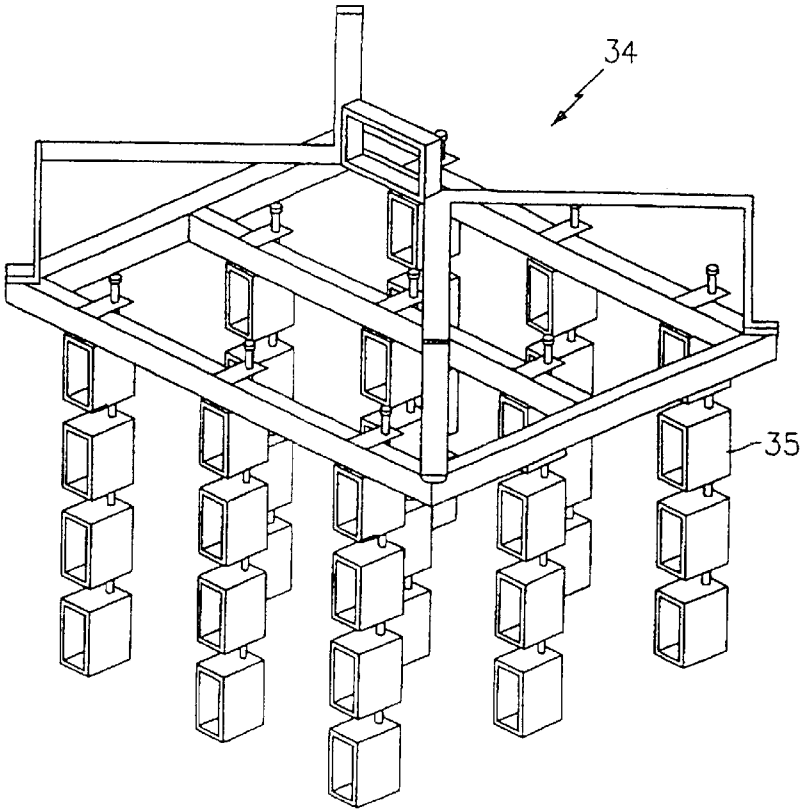
FIG. 4 illustrates a fixture for holding the workpieces to be treated.

Referring now to FIG. 4, the workpiece(s) 33 to be introduced into the stripping solution are clamped into the fixture 34 using workpiece holders 35. The workpiece holders 35 may comprise any suitable means known in the art. The fixture 34 delivers current from the buss strips 36 to each workpiece 33. The fixture 34 may be moved towards and away from the stripping tank 12 using any suitable means known in the art such as a crane or a hoist movable along a track (not shown). The fixture 34 may also be used to transport the workpiece(s) 33, after the stripping operation has been completed, to the rinse tank 14 where they are rinsed to remove any residual stripping solution or metals.

The rinse tank 14 contains a conductivity probe 26 for monitoring the quality of the rinse water in the tank. The rinse tank 14 also contains a filter 28, such as a mixed-resin ion exchange filter, and a circulating pump 30 to purify the rinse water of acid and dissolved metal. The filter 28 preferably operates at all times. If the conductivity of the rinse water in the rinse tank exceeds a predetermined value as measured by the probe 26, the operator is notified that corrective action is required, i.e. replacement of the filter 28. Optionally, the system may be interlocked until the filter 28 is changed.

Figure 6:
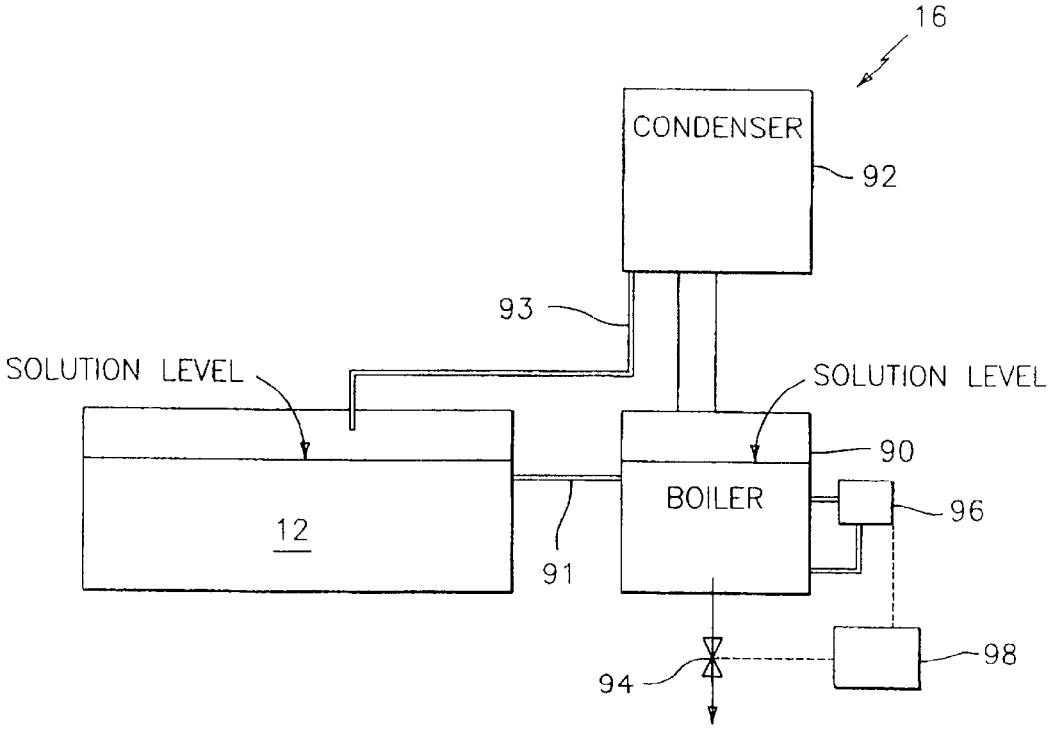
FIG. 6 is a schematic representation of a distillation unit used in the system of FIG. 1 to recycle the acid stripping solution.

Referring now to FIG. 6, acid recovery and acid regeneration is accomplished by atmospheric distillation of the used stripping solution in the distillation unit 16 using a low cost acid distillation system sized for the stripping application. In this distillation system, the used acid solution is gravity fed from the strip tank 12 via line 91 to a boiler 90 in the distillation unit 16 where the acid is vaporized, leaving the dissolved metals in the used acid solution in the boiler 90. The thus generated acid vapor travels up into a condenser 92 where it is condensed back into the liquid phase. From here, the purified acid returns to the strip tank 12 by gravity via return line 93. The dissolved metals accumulate in the boiler 90 effectively concentrated to approximately 100 grams per liter total metal, resulting in a 10× reduction in waste over the typical stripping operation. The concentrated dissolved metals are periodically purged from the boiler 90. The purging is accomplished by a solenoid actuated valve 94 controlled by an electrodeless conductivity probe 96 and a conductivity meter 98.

Figure 2:
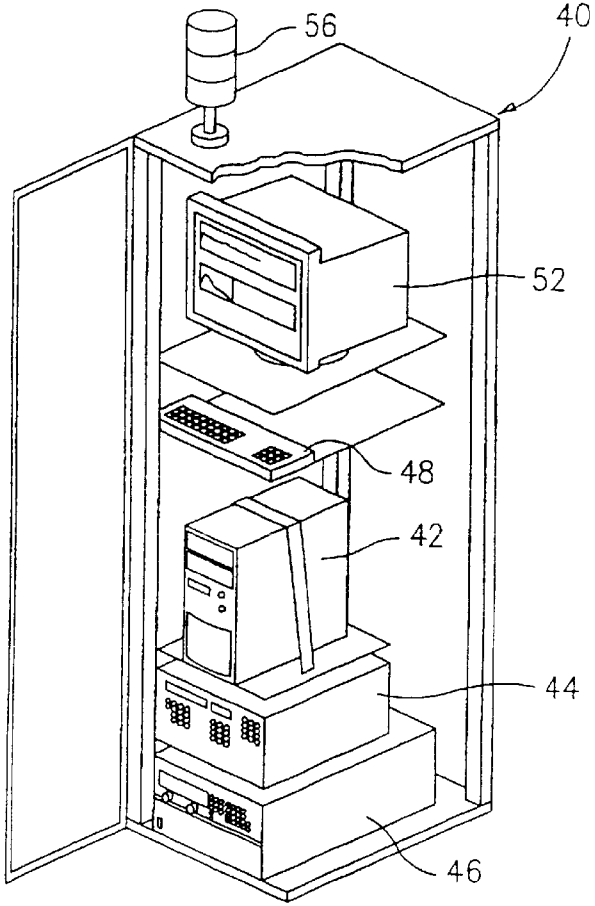
FIG. 2 illustrates a module for allowing an operator to control the system.

As shown in FIG. 2, the system 10 is controlled by a module 40 containing a computer 42, a data acquisition unit 44, and a programmable power supply 46. The computer 42 may comprise any suitable computer known in the art which has been programmed in any language to carry out the functions hereinafter discussed. An operator interface 47 including a keyboard 48, a mouse (not shown), a CRT 52, push button controls (not shown), and a signal light tree 56 is built into the module 40. The module 40 may be mounted on the skid 18 or may be a stand alone module separate from the skid 18.

Figure 5:
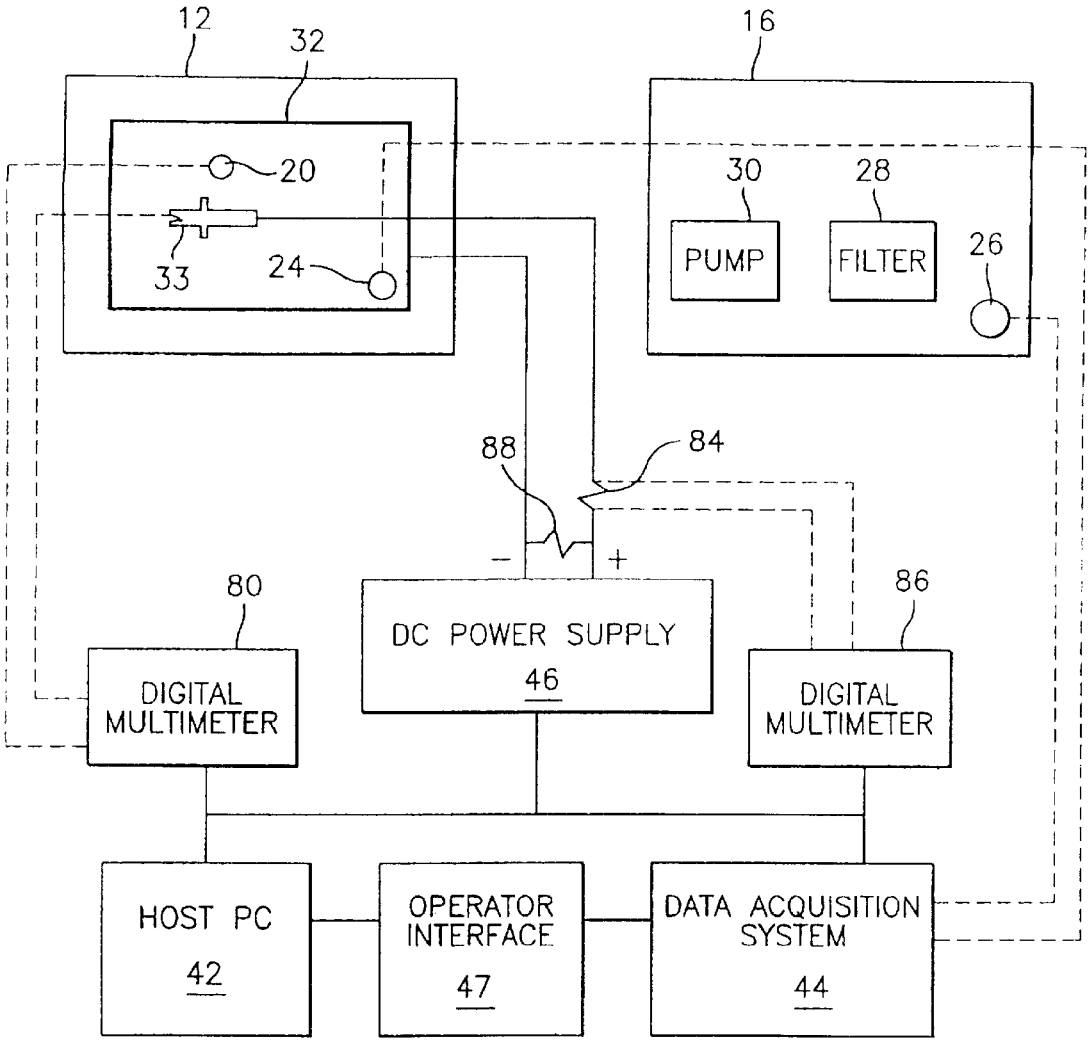
FIG. 5 illustrates a data acquisition and control system used in the system of FIG. 1.

Referring now to FIG. 5, the data acquisition and control system employed in the system 10 of the present invention is illustrated. A digital multimeter 80 is provided to measure the voltage potential between the reference electrode 20 and the workpiece(s) 33 from which the coating is to be/being stripped. A predetermined target voltage is maintained during the stripping process by adjusting the current output of the DC power supply 46, which is preferably operated in a constant current mode.

The value of the adjustment required to maintain the target voltage is determined by the computer 42 preferably using an algorithm which tracks the change in the cell current versus the change in potential between the reference electrode 20 and the workpiece(s) 33. The operating mode of the power supply 46 is thus monitored to prevent invalid adjustments. When the power supply 46 approaches its voltage output limit, it automatically switches into a constant voltage mode. No power supply adjustments are made under these conditions until the voltage output decreases and the power supply 46 switches back into a constant current mode. The stripping cycle end point is determined by the computer 42 preferably using a multiple regression analysis of elapsed time and cell amperage.

Actual cell current in the stripping tank 12 is monitored by measuring the voltage across a shunt resistor 84 via a second digital multimeter 86. The shunt resistor 84 is electrically connected to a counter electrode or a workpiece in the stripping tank and to the power supply 46. A power supply shorting resistor 88 is provided in the control system to allow for finer adjustments to the cell current as the cell resistance increases due to the presence of an increased presence of dissolved metals in the stripping solution. A conductivity probe 24 in the stripping tank 12 is used to monitor the conductivity and temperature of the stripping solution and to transmit a first signal representative of these properties to the data acquisition system 44. The metal loading of the stripping solution may be determined in any manner known in the art by the computer 42 such as through the use of a linear regression analysis of the solution temperature and conductivity. The acid concentration of the stripping solution may be determined by the computer 42 using an algorithm based on solution conductivity.

As previously discussed, the conductivity probe 26 in the rinse tank 14 notifies the operator whether the rinse solution is within acceptable limits or not. As shown in FIG. 5, the probe 26 transmits a second signal representative of the state of the rinse solution acceptability to the data acquisition system 44. If the rinse solution is not acceptable, the filter 28 is changed and operated until the rinse solution returns to an acceptable state.

The operator interface 47 includes a set of interactive screens for selecting the parameters for the strip cycle, and digital inputs from front panel pushbuttons/selector switches to provide various other control features. For example, the operator interface 47 may include a "Cycle Start" pushbutton to begin a strip cycle; a key operated "Run/Stop" selector switch to provide a level of security against unauthorized use; and a "Controls On" pushbutton used to energize all subsystems. Two "Emergency Stop" latching mushroom buttons, one on the operator console and another on the strip tank 12, may be provided to de-energize the power supply 46. The Christmas tree 52 provides a visual indication of system status. A green light may indicate that a cell setup is in progress (part loading, etc.). A yellow light may indicate that a strip cycle is in progress. A red light may indicate that the system is idle.

The above describes a system which may use a type of reference electrode arrangement (i.e. a Ag/AgCl reference electrode placed in close proximity to the workpiece to avoid the need for solution IR corrections). The reference electrode may also be placed further away from the workpiece for ease of use with the resulting potential being corrected for this IR effect. An array of platinum or hydrogen reference electrodes can also be used, each in close proximity to a given workpiece, to more precisely monitor and control large numbers of parts being strapped at one time. These latter two arrangements can also be employed together to reduce the time required to saturate the solution with hydrogen. The remote Ag/AgCl electrode and IR correction to monitor and control the potential until such time as sufficient hydrogen has been generated to switch over to the Pt array electrode control methodology may be used in the system of the present invention.

The system of the present invention may be used in a wide variety of environments to remove a wide variety of coatings. For example, the system 10 could be used to remove thermal barrier coatings, aluminide coatings, and MCrAlY coatings from turbine blades and vanes and other airfoils. The system could also be used to remove solder or braze joining compounds from metal workpieces. Still further, the system of the present invention could be used to remove electroplated coatings from steel members.

While various mathematical techniques have been discussed herein to carry out certain functions and analyses, it should be apparent to those skilled in the art that other mathematical techniques may be used to carry out the analyses and functions set forth hereinbefore.

While the invention has been described above with reference to specific embodiments thereof, it is apparent that many changes, modifications, and variations can be made without departing from the inventive concept disclosed herein. Accordingly, it is intended to embrace all such changes, modifications and variations which fall within the broad scope of the attached claims.

What is claimed is:

1. A coating removal system comprising:

a stripping tank containing an electrolyte bath stripping solution for removing a coating from at least one workpiece immersed in said electrolyte bath while a controlled absolute electrical potential is maintained on said at least one workpiece with respect to a reference electrode immersed in said electrolyte bath;

a rinse tank containing a rinse solution for rinsing said at least one workpiece after completion of removal of said coating from said at least one workpiece; and a distillation unit for receiving electrolyte from said stripping tank containing dissolved metals, for purifying said electrolyte received from said stripping tank, and for returning said electrolyte in a purified form to said stripping tank.

2. A coating removal system according to claim 1, wherein said stripping tank has at least one counter electrode for applying a current to each workpiece immersed in said stripping tank.

3. A coating removal system according to claim 2, wherein said at least one counter electrode comprises a counter electrode array designed to provide a symmetrical potential distribution to each said workpiece.

4. A coating removal system according to claim 3, wherein said counter electrode array is formed from an electrically conductive material and said reference electrode is a hydrogen reference electrode array.

5. A coating removal system according to claim 3, wherein said counter electrode array has a front wall, a rear wall, two side walls connecting the front and rear walls, and at least one insert extending between said front and rear walls.

6. A coating removal system according to claim 5, further comprising a fixture for holding said at least one workpiece and immersing said at least one workpiece in said electrolyte bath stripping solution and at least one buss strip affixed to one of said walls of said counter electrode array for contact by said fixture, whereby current is delivered to each said workpiece.

7. A coating removal system according to claim 1, wherein said stripping tank, said rinse tank, and said distillation unit are mounted on a skid.

8. A coating removal system according to claim 1, wherein said distillation unit has:

a boiler for receiving used electrolyte from said stripping tank and for evaporating said used electrolyte leaving dissolved metals in the boiler; and a condenser for receiving said evaporated electrolyte and condensing said electrolyte into a purified liquid form.

9. A coating removal system according to claim 8, wherein an acid return line connects said condenser to said stripping tank so that said purified electrolyte may be returned to said stripping tank by gravity.

10. A coating removal system according to claim 9, wherein said distillation unit further has:

a solenoid actuated valve for purging collected metals from said boiler; and an electrodeless conductivity probe and a conductivity meter for controlling said valve.

11. A coating removal system according to claim 1, wherein said rinse tank has:

a conductivity probe for monitoring the quality of the rinse solution in said rinse tank;

a circulating pump within the rinse tank; and a filter for removing dissolved metals from said rinse solution.

12. A coating removal system according to claim 1, further comprising a power supply and a first digital multimeter for measuring the potential between said reference electrode and said at least one workpiece and for supplying a signal representative of said potential to a computer.

13. A coating removal system according to claim 12, further comprising said power supply having an adjustable current output for maintaining a predetermined target voltage between said reference electrode and said at least one workpiece and said computer being used to modify a power supply current set point as a function of a change in potential between the reference electrode and the at least one workpiece.

14. A coating removal system according to claim 13, further comprising a first conductivity probe in said stripping tank for monitoring electrical conductivity and temperature of the electrolyte bath, a data acquisition system for receiving data from said first conductivity probe, and said computer being connected to said data acquisition system and being programmed to determine acid concentration in the strip solution.

15. A coating removal system according to claim 16, further comprising:

a second conductivity probe in said rinse tank for monitoring the quality of the rinse solution in the rinse tank and for producing a second signal representative of said rinse solution quality; and said data acquisition system receiving said second signal from said second conductivity probe and notifying an operator of said rinse solution quality.

16. A coating removal system according to claim 12, further comprising a shunt resistor electrically connected to a counter electrode or the at least one workpiece in said stripping tank and to the power supply and a second digital multimeter for monitoring actual current in said stripping tank and supplying a signal representative of said monitored current to said computer.

17. A coating removal system according to claim 14, further comprising a power supply shorting resistor for allowing fine adjustments to said cell current as cell resistance increases.

18. A coating removal system according to claim 1, wherein said electrolyte bath in said stripping tank contains from about 3% to about 15% volume of an acid selected from the group consisting of nitric acid and hydrochloric acid.

19. A process for removing a coating from a workpiece using an electrochemical bath and for regenerating and recycling said electrochemical bath comprising the steps of:

stripping the coating from the workpiece by immersing the workpiece in said electrochemical bath for a sufficient period of time to remove the coating from the workpiece while the workpiece in the electrochemical bath is maintained with a controlled absolute electrical potential with respect to a reference electrode; and regenerating said electrochemical bath by atmospheric distillation.

20. The process according to claim 19, wherein said regenerating step comprises:

introducing used electrolyte from said bath containing dissolved metals into a boiler;

evaporating said used electrolyte while leaving the dissolved metals in said boiler;

condensing said evaporated electrolyte to return said electrolyte to a liquid phase; and reintroducing said electrolyte into said electrochemical bath.

21. The process according to claim 20, wherein said reintroducing step comprises reintroducing said electrolyte using a gravity feed.

22. The process according to claim 20, further comprising purging said dissolved metals in a concentrated form from said boiler.

23. The process according to claim 19, further comprising removing said workpiece from said electrochemical bath after completion of the stripping of the coating and immersing said workpiece into a rinse solution in a rinse tank.

24. The process according to claim 19, further comprising monitoring rinse solution quality and notifying an operator when said quality is unacceptable.

25. The process according to claim 19, further comprising maintaining a predetermined target voltage during the stripping step by adjusting a current output of a power supply supplying a current to the workpiece and to an electrode array in a tank containing said workpiece and said electrochemical bath.

26. The process according to claim 25, wherein said predetermined target voltage maintaining step comprises adjusting a power supply set point as a function of a change in said potential.

27. The process according to claim 25, further comprising monitoring cell current within said tank containing said workpiece and said electrochemical bath.

28. The process according to claim 27, wherein said cell current monitoring step comprises providing a shunt resistor and measuring the voltage across said shunt resistor using a digital multimeter.

29. The process according to claim 28, further comprising providing a shorting resistor and using said shorting resistor to make fine adjustments to said cell current as cell resistance increases.

30. The process according to claim 25, further comprising monitoring conductivity and temperature of said electrochemical bath and determining metal loading of said electrochemical bath solution using said monitored conductivity and temperature.

* * * * *

UNITED STATES PATENT AND TRADEMARK OFFICE

CERTIFICATE OF CORRECTION

PATENT NO. : 6,428,683 B1
DATED : August 6, 2002
INVENTOR(S) : Mark R. Jaworowski et al.

It is certified that error appears in the above-identified patent and that said Letters Patent is hereby corrected as shown below:

Column 10,
Line 34, “claim 16” should read -- claim 14 --.
Line 50, “claim 14” should read -- claim 16 --.

Signed and Sealed this

Eighteenth Day of March, 2003

JAMES E. ROGAN
*Director of the United States Patent and Trademark Office*